US008651482B2

(12) United States Patent
Fernandez et al.

(10) Patent No.: US 8,651,482 B2
(45) Date of Patent: Feb. 18, 2014

(54) PRINT MEDIA PICKUP ARM BETWEEN FEED ROLLER AND MEDIA SUPPORT

(75) Inventors: Ismael Chanclon Fernandez, Barcelona (ES); Jordi Gimenez, Barcelona (ES); David Chanclon Fernandez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 223 days.

(21) Appl. No.: 13/154,596

(22) Filed: Jun. 7, 2011

(65) Prior Publication Data

US 2012/0313314 A1 Dec. 13, 2012

(51) Int. Cl.
*B65H 5/06* (2006.01)

(52) U.S. Cl.
CPC ..... *B65H 5/062* (2013.01); *Y10S 271/90* (2013.01)
USPC ..... 271/275; 271/3.21; 271/311; 271/900; 226/5

(58) Field of Classification Search
USPC ..... 271/3.21, 275, 311, 900; 226/5
See application file for complete search history.

(56) References Cited

U.S. PATENT DOCUMENTS

| | | | | |
|---|---|---|---|---|
| 5,589,925 | A * | 12/1996 | Cahill | 271/307 |
| 6,398,330 | B1 | 6/2002 | Chua | |
| 6,629,788 | B2 | 10/2003 | Miranda | |
| 7,673,985 | B2 | 3/2010 | Sasa | |
| 2009/0218763 | A1 | 9/2009 | Terada | |

* cited by examiner

*Primary Examiner* — Gerald McClain

(57) ABSTRACT

A pickup arm for print media arranged to engage a roller.

10 Claims, 6 Drawing Sheets

PRINT MEDIA PICKUP ARM BETWEEN FEED ROLLER AND MEDIA SUPPORT

BACKGROUND

Printers are sometimes provided with rollers for transporting the print media. Printers are sometimes provided with a print media support for supporting the media while it is printed. When loading the media, at least one roller transports the leading edge of the media to the print media support.

BRIEF DESCRIPTION OF THE DRAWINGS

For the purpose of illustration, certain examples of the present invention will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that also examples or elements that are not literally disclosed may be derived from the description and drawings by a person skilled in the art.

Figure 1:
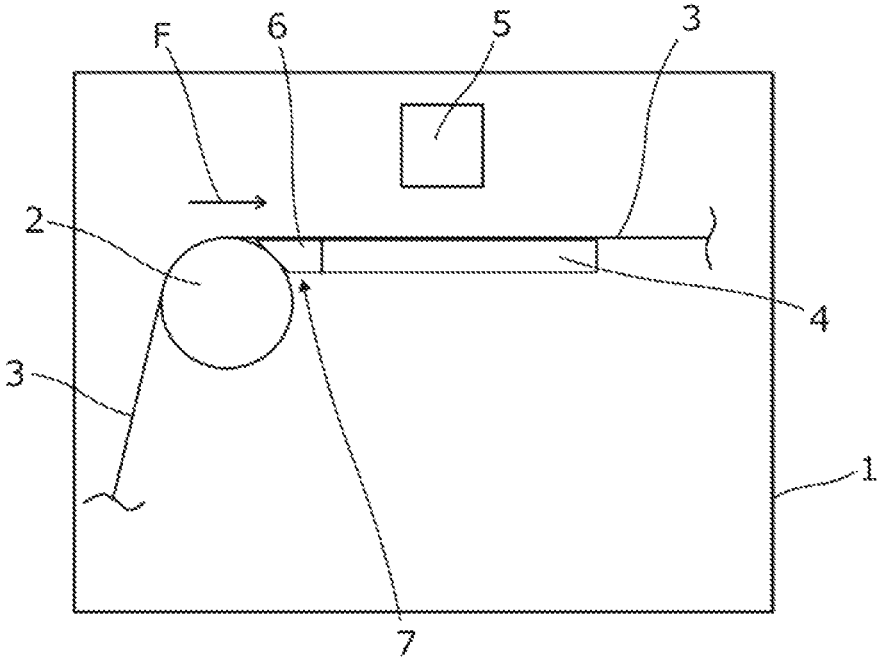
FIG. 1 shows a diagram of an example of a printer with a pickup arm.

FIG. 1 shows a diagram of an example of a printer 1. The printer 1 may be a large format printer, for example a large format inkjet printer. The printer 1 comprises at least one roller 2 for feeding and/or transporting media 3. A media feed direction F is indicated in the drawing. The shown roller 2 may comprise a drive roller. Downstream of the roller 2, a media support 4 is provided. The media support 4 may comprise a print platen. The media support 4 is provided under a printhead 5, for supporting the media 3 during printing.

In the shown example, a pickup arm 6 is attached to the media support 4. The pickup arm 6 engages the roller 2. In operation, the pickup arm 6 is arranged to prevent that the leading edge of the media 3 falls into an area 7 between the roller 2 and the media support 4. In practice, the pickup arm 6 may function as a bridge between the roller 2 and the media support 4 and may be regarded as a preventive measurement. In this description, the pickup arm's bridging function will be referred to as "picking up" the media 3, even if in practice the pickup arm 6 does not necessarily touch the media 3 when it passes over from the roller 2 to the media support 4.

Figure 2:
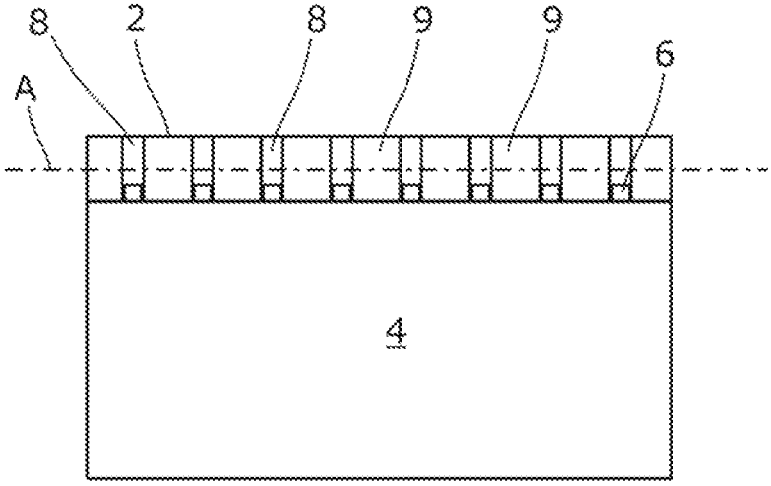
FIG. 2 shows a top view of an example of an assembly of a roller, a media support and pickup arms of a printer.

FIG. 2 shows a top view of an example part of a printer 1, including a roller 2, a media support 4 and pickup arms 6.

Multiple pickup arms 6 are provided. For example, enough pickup arms 6 are provided to facilitate picking up of different media sizes by one or more pickup arms 6.

The roller 2 includes a rotation axis A around which it rotates. The shown roller 2 has a substantially cylindrical shape. The pickup arms 6 engage the roller 2 during rotation, closing off the open area 7. In an example, the roller 2 includes smooth surface portions 8. The pickup arm 6 engages the roller 2 at the smooth surface portion 8. In an example, the smooth surface portions 8 are arranged to prevent wear of the pickup arm 6. In another example, the smooth surface portions 8 are arranged to prevent friction between the pickup arm 6 and the roller 2, for a smooth rotation of the roller 2. The smooth surface portions 8 may comprise wear resistant material. In certain examples, the smooth surface portion 8 comprises reinforced metal, stainless steel and/or another metal. In an example, the smooth surface portion 8 may comprise relatively thin bands, tapes, ribbons, steel plates, etc. that are applied or adhered to the roller 2. In again other examples, the smooth surface portions 8 may be obtained by providing a suitable treatment at preselected locations, for example by providing polishing, sanding, etc.

In an example, the roller 2 includes friction surface portions 9. The friction surface portions 9 may be arranged next to and between the smooth surface portions 8. In an example, the friction surface portions 9 cover a larger surface area of the roller 2 than the smooth surface portions 8. The friction surface portions 9 are arranged to provide for a certain friction between the roller 2 and the media 3 so that media 3 is advanced in a controlled manner. For example, the friction surface portion 9 comprises an abrasive and/or an elastomeric surface. An example abrasive surface portion comprises a surface that is treated to be abrasive, for example a surface comprising small adhered particles arranged to provide for a suitable friction between the roller 2 and the media 3. An example elastomeric surface may comprise rubber, or other elastomeric material that may provide for a suitable friction between the roller 2 and the media 3.

The smooth surface portion 8 may comprise a treated roller surface, or an applied band, or the like. A substantially cylindrical shape of the roller 2 may be maintained. A relatively cost efficient roller 2, or reduced complexity may be obtained. For example the roller 2 may have a relatively continuous cylindrical shape along its surface. For example, the smooth surface portion 8 and the friction surface portion 9 may show no or almost no difference in height with respect to the rotation axis A. For example the difference in height between the neighboring portions 8, 9 may be approximately 1 millimeters or less, or 2 millimeters or less.

Figure 3:
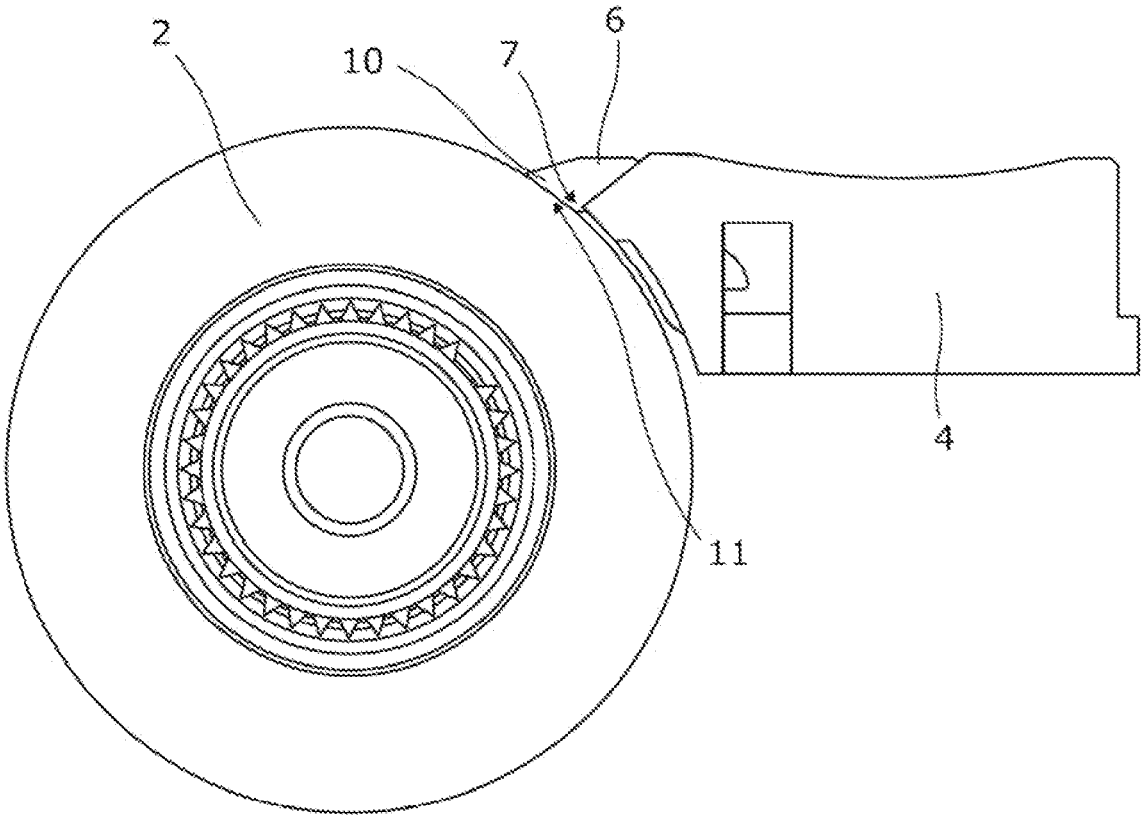
FIG. 3 shows a side view of another example of an assembly of a roller, a media support and a pickup arm of a printer.

Another example assembly of a roller 2, a media support 4 and a pickup arm 6 is shown in side view in FIG. 3. Here, the pickup arm 6 comprises a separate part that is mounted to the media support 4. The pickup arm 6 includes an engagement finger 10 that engages the roller 2. The engagement finger 10 is arranged to slide over the roller 2, while the roller 2 rotates. The engagement finger 10 has an engagement surface 11. In an example, the pickup arm 6 and/or at least the engagement finger 10 and/or at least the engagement surface 11 includes wear resistant material, to prevent wear of the pickup arm 6 near the engagement surface 11 by the rotating roller 2. In addition, the engagement surface 11 may be arranged to reduce friction. For example, the pickup arm 6 comprises a reinforced polymer structure, for example of a fiber reinforced polymer, or any other suitable wear resistant polymer.

Figure 4:
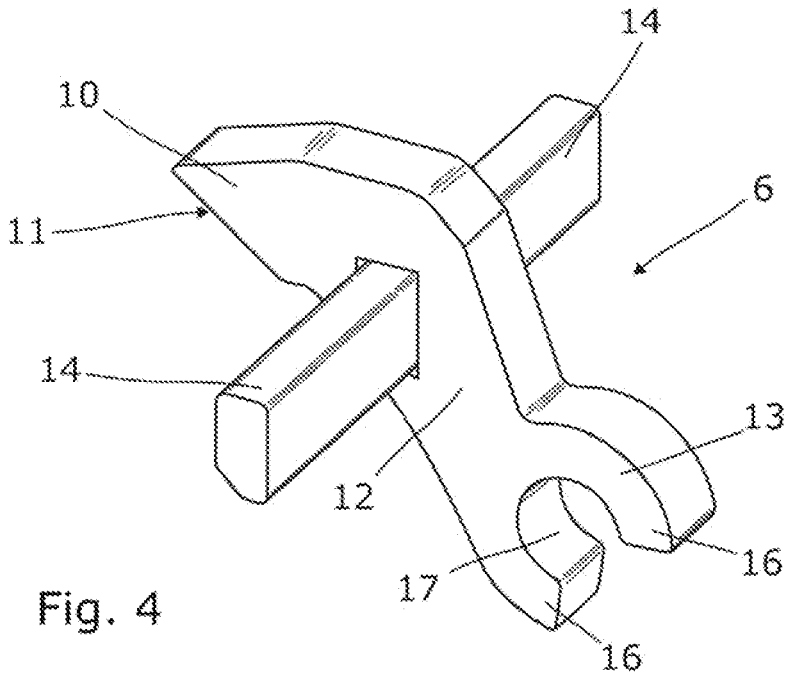
FIG. 4 shows a perspective view of the example of the pickup arm of FIG. 3.

FIG. 4 shows an example of a pickup arm 6. The pickup arm 6 may comprise a single cast, for example obtained through injection molding, compression molding, or another type of molding. The example pickup arm 6 comprises a body 12, from which the engagement finger 10, a clip feature 13, and two wings 14 extend. The engagement finger 10 and the clip feature 13 are arranged on opposite sides of the body 12 with respect to each other. In one example, the engagement finger 10 is arranged at a head of the body 12 and the clip feature 13 is arranged at a rear of the body 12.

In the example of FIG. 4, the pickup arm 6 comprises at least one wing 14 that protrudes from the body 12 in a lateral direction. In the shown example the pickup arm 6 has a pair of wings 14, attached to opposite sides of the body 12. In assembled condition, the wings 14 engage the media support 4. In an example, the media support 4 presses against the wings 14 for biasing the pickup arm 6 towards the rotating roller 2.

Figure 5:
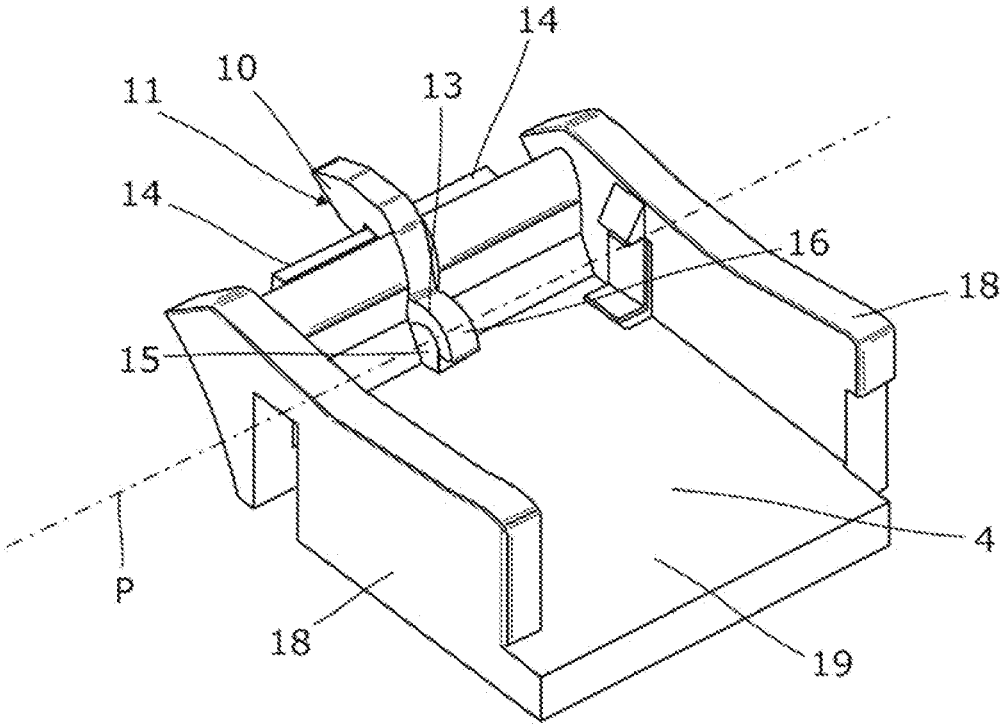
FIG. 5 shows a perspective view of a portion of the media support and pickup arm of FIG. 3.

FIG. 5 shows a part of a media support 4 with a pickup arm 6. For the purpose of illustration, parts of the media support 4 on either side of ribs 18 are cut off. As can be seen, the clip feature 13 is arranged to clip the pickup arm 6 to the media support 4. The media support 4 comprises a corresponding clip support feature 15, to which the clip feature 13 is clipped. The clip feature 13 is arranged so that the pickup arm 6 pivots around the clip support feature 15. The clip feature 13 may comprise a pair of clip fingers 16. The clip support feature 15 may partly define a cylindrical shape. An inner clipping surface 17, extending on the inner sides of the clip fingers 16, may define a part of a cylinder, corresponding to the cylindrical shape of the clip support feature 15. In an example, the clip support feature 15 is part of the media support 4. The clip support feature 15 has a pivot axis P, about which the pickup arm 6 is arranged to pivot. The pivot axis P is substantially parallel to the rotation axis A or the roller 2.

In other examples (not shown), the pickup arm 6 comprises another connection feature for connecting the pickup arm 6 to the media support 4. For example, the pickup arm 6 may be connected in any suitable manner. For example, the pickup arm 6 may be connected to the media support 4 by hinges. In certain illustrative examples the pickup arm 6 may be connected to the media support 4 by using any of pins, screws, hinges, springs, etc.

Figure 6:
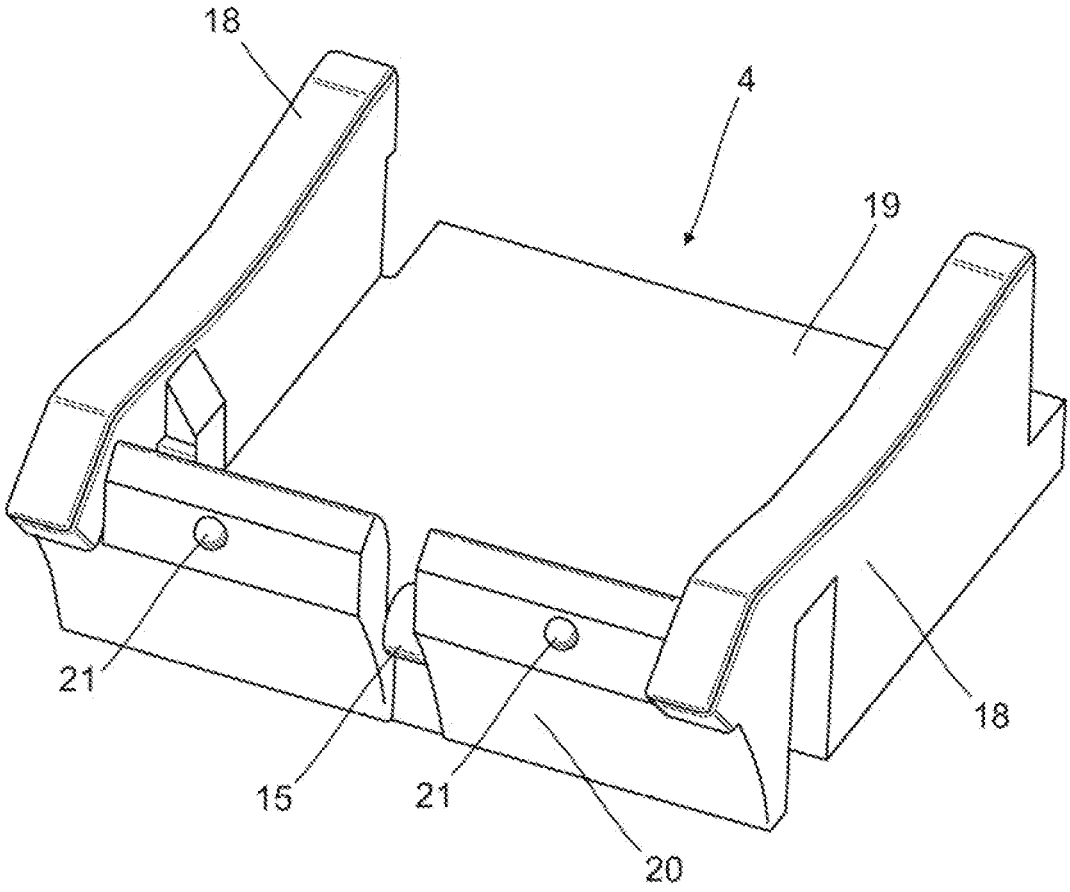
FIG. 6 shows a perspective view of the example of the media support of FIGS. 3 and 5.

FIG. 6 shows a part of an example media support 4. As can be seen, the example media support 4 may comprise ribs 18 for supporting the print media 3, allowing for some space between the media 3 and a bottom 19 of the media support 4. The shown media support part approximately defines the shape of a tray, with the ribs 18 and a front wall 20 acting as walls. In practice, the media support 4 is wider and the shape of FIG. 6 repeats itself along the roller 2. A full media support 4 may comprise multiple of said trays. The clip support feature 15 may be arranged between two ribs 18, in the front wall 20. In the example the pickup arm 6 extends parallel to the ribs 18, perpendicular to the roller 2.

In an example, the media support 4 comprises at least one relatively resilient protrusion 21 that is arranged to engage the pickup arm 6 for biasing the pickup arm 6 against the roller 2. The protrusions 21 may protrude from the front wall 20. The media support 4 may be a single cast including said protrusions 21. The media support 4 may be formed and/or molded out of polymer material. The protrusions 21 may be relatively resilient as compared to the pickup arm 6. In assembled condition, the clip feature 13 of the pickup arm 6 is mounted to the clip support feature 15, while the wings 14 engage the protrusions 21, and the engagement finger 10 engages the roller 2. The pickup arm 6 may be held in its rotational position, as shown in FIG. 3, by the roller 2 and the protrusions 21. As the protrusions 21 are resilient, the pickup arm 6 is biased towards the rotating roller 2, while the engagement surface 11 slides over the roller 2. In other examples, instead of or in addition to the protrusions 21 separate resilient and/or elastomeric elements may be provided for biasing the pickup arm 6. For example, one or more rubber elements and/or one or more springs may be provided. For example, the protrusions 21 may be used to connect the rubber element or spring, or other resilient element. In again other examples, the pickup arm 6 is maintained against the roller 2 by the media support 4 without protrusions.

In another example (not shown), the pickup arm 6 is not provided with wings 14 for engaging the protrusions 21. The protrusions 21 or other resilient elements may engage any suitable surface of the pickup arm 6 for biasing in the direction of the roller 2.

Figure 7:
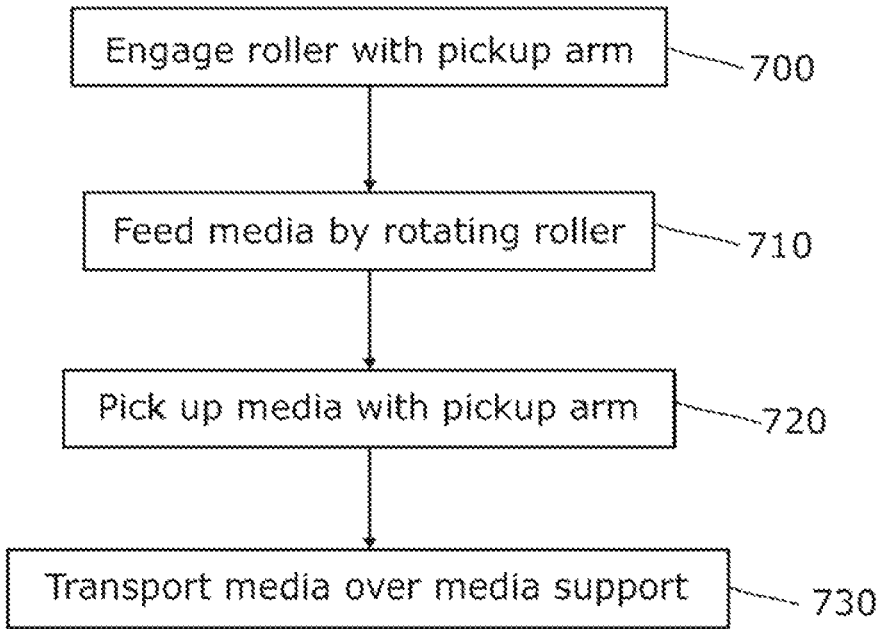
FIG. 7 shows a flow chart of an example of a print method.

FIG. 7 shows a flow chart of an example print method. The print method may comprise engaging a rotating roller 2 with a pickup arm 6 (block 700). The print method may further comprise feeding media 4 by the rotating roller 2 (block 710). One or more rollers 7 may transport the media 4. The print method may further comprise picking up the media 4 with the pickup arm 6 (block 720). The pickup arm 6 may prevent that a leading edge of the media 4 enters an area 7 between the roller 2 and the media support 4 which could lead to an interruption of the media advance process. The print method may further comprise transporting the media 4 over the media support 4 (block 730), whereby the media 3 passes under the printhead 5 for printing.

Figure 8:
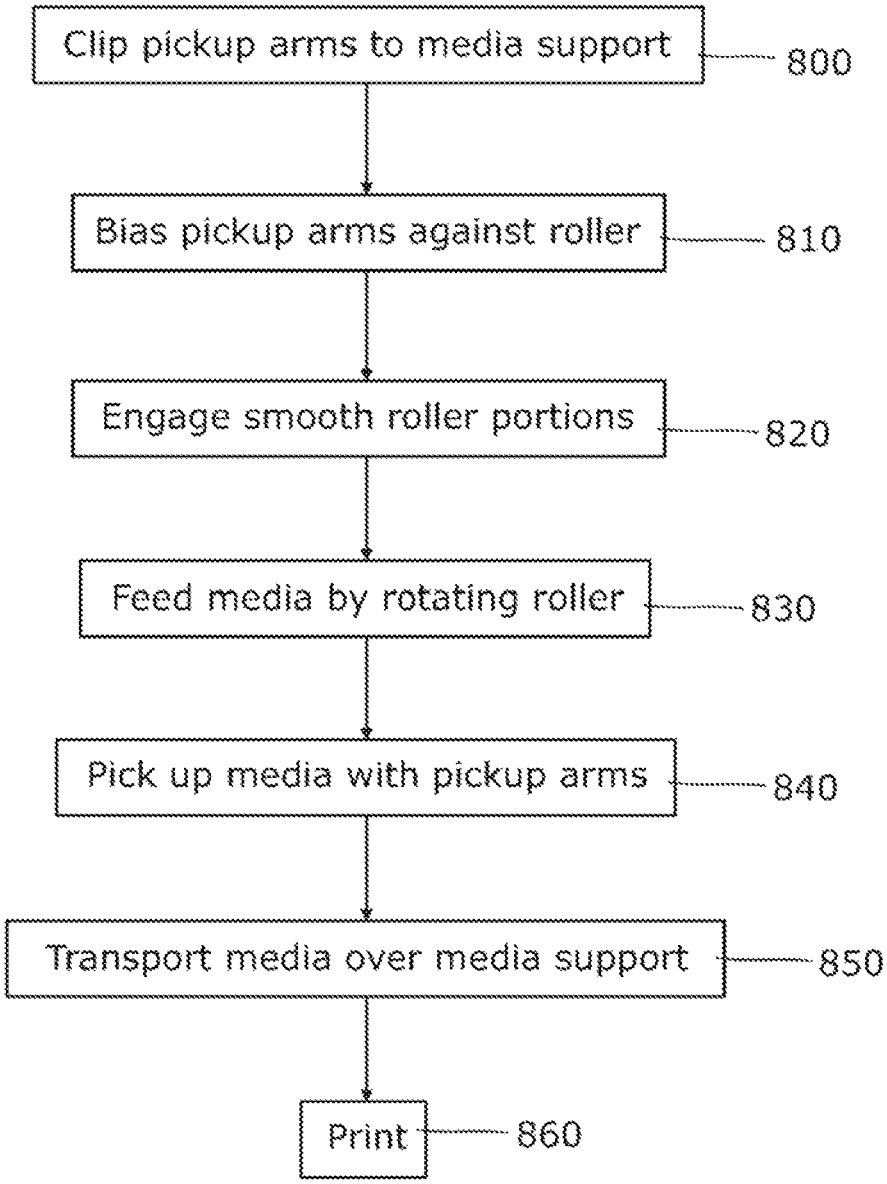
FIG. 8 shows a flow chart of another example of a print method.

Another example of a print method is illustrated by the flow chart of FIG. 8. In the example print method of FIG. 8, the pickup arms 6 are clipped to the media support 4 (block 800). For example, the respective clip features 13 are clipped to the corresponding clip support features 15. The pickup arms 6 are biased towards the roller 2 by a resilient force (block 810), for example by using the protrusions 21 of the media support 4. The protrusions 21 may engage the wings 14. The respective engagement fingers 10 may engage corresponding smooth surface portions 8 of the roller 2 (block 820). The media 3 is fed by rotating the roller 2 (block 830). The engagement finger 10 may slide over the is rotating smooth surface portions 8 during rotation. The pickup arms 6 may pick up the media 4 when the leading edge of the media 4 passes over the area 7 between the roller 2 and the media support 4 (block 840). The media 3 is transported over to the media support 4 by the roller 2 (block 850) and the media 3 is printed (block 860).

The above description is not intended to be exhaustive or to limit this disclosure to the examples disclosed. Other variations to the disclosed examples can be understood and effected by those skilled in the art from a study of the drawings, the disclosure, and the claims. The indefinite article "a" or "an" does not exclude a plurality, while a reference to a certain number of elements does not exclude the possibility of having more or less elements. A single unit may fulfill the functions of several items recited in the disclosure, and vice versa several items may fulfill the function of one unit. Multiple alternatives, equivalents, variations and combinations may be made without departing from the scope of this disclosure.

The invention claimed is:

1. Printer, comprising a printhead, a roller having a rotation axis and operable to feed print media in a downstream direction perpendicular to the rotation axis, a media support arranged downstream of the roller under the printhead, the media support comprising a bottom section, a front section extending up from the bottom section, and side walls extending up from the bottom section and having top surfaces exposed to support print media received from the roller above the bottom section, and a pickup arm attached to the front section of the media support and engaging the roller, wherein the pickup arm is pivotable about a pivot axis parallel to the rotation axis of the roller and extends from the front section of the media support to a distal end that slides over the roller and supports the print media from the roller to the top surfaces of the side walls of the media support to prevent the print media from passing between the roller and the media support.

2. Printer according to claim 1, wherein the pickup arm comprises a clip feature with which it is clipped to the front section of the media support.

3. Printer according to claim 2, wherein the media support comprises a clip support feature defining a pivot axis, and the clip feature of the pickup arm is clipped to the clip support feature for pivoting the pickup arm about the pivot axis.

4. Printer according to claim 3, wherein the pickup arm comprises:

an arm body; and an engagement finger arranged to slide over the roller on the opposite side of the arm body with respect to the clip feature.

5. Printer according to claim 4, wherein the pickup arm comprises at least one wing that protrudes from the arm body in a lateral direction parallel to the rotation axis of the roller.

6. Printer according to claim 1, wherein the media support comprises at least one resilient protrusion that is arranged to engage the pickup arm and bias the pickup arm towards the roller.

7. Printer according to claim 1, wherein the roller comprises a substantially continuous cylindrical shape.

8. Printer according to claim 7, wherein:

the roller comprises series of alternating, first and second cylindrical surface regions coaxially distributed along a rotational axis of the roller and exposed to contact the print media with the first surface regions engaging the print media with higher friction than the second surface regions; and the pickup arm engages the second surface regions without contacting the first surface regions.

9. Printer according to claim 1, further comprising additional ones of the pickup arm attached to the media support, wherein each additional pickup arm extends from the front wall of the media support to a respective distal that slides over the roller and supports the print media from the roller to the media support to prevent the print media from passing between the roller and the media support.

10. Printer according to claim 1, wherein the pickup arm engages the roller with an engagement surface that comprises a reinforced polymer structure.

* * * * *

UNITED STATES PATENT AND TRADEMARK OFFICE

CERTIFICATE OF CORRECTION

PATENT NO. : 8,651,482 B2
APPLICATION NO. : 13/154596
DATED : February 18, 2014
INVENTOR(S) : Fernandez et al.

It is certified that error appears in the above-identified patent and that said Letters Patent is hereby corrected as shown below:

In the Claims

Column 6, line 11, in Claim 8, after “comprises” insert -- a --.

Column 6, line 11, in Claim 8, delete “alternating,” and insert -- alternating --, therefor.

Column 6, line 22, in Claim 9, after “distal” insert -- end --.

Signed and Sealed this
Tenth Day of June, 2014

Michelle K. Lee

Michelle K. Lee
*Deputy Director of the United States Patent and Trademark Office*